US005962973A

United States Patent [19]

Rice

[11] Patent Number: 5,962,973

[45] Date of Patent: Oct. 5, 1999

[54] OPTICALLY-COATED DUAL-FILAMENT BULB FOR SINGLE COMPARTMENT HEADLAMP

[75] Inventor: Lawrence Marion Rice, Anderson, Ind.

[73] Assignee: Guide Corporation, Anderson, Ind.

[21] Appl. No.: 08/870,221

[22] Filed: Jun. 6, 1997

[51] Int. Cl.[6] ..... H01K 1/26

[52] U.S. Cl. ..... 313/580; 313/492; 313/631

[58] Field of Search ..... 313/3, 492, 493, 313/112, 113, 115, 580, 613, 631, 634, 635, 238, 239, 240

[56] References Cited

U.S. PATENT DOCUMENTS

| | | | |
|---|---|---|---|
| 3,908,144 | 9/1975 | Rudd | 313/114 |
| 4,160,929 | 7/1979 | Thorington et al. | 313/112 |
| 4,275,327 | 6/1981 | Walsh | 313/111 |
| 4,285,032 | 8/1981 | Honda et al. | 362/224 |
| 4,311,940 | 1/1982 | Fitzgerald et al. | 313/273 |
| 4,480,296 | 10/1984 | Gagnon et al. | 362/211 |
| 4,652,789 | 3/1987 | Kawakatsu et al. | 313/112 |
| 4,710,676 | 12/1987 | Morris et al. | 313/579 |
| 5,253,153 | 10/1993 | Mathews et al. | 362/310 |
| 5,506,471 | 4/1996 | Kosmatka et al. | 313/635 |
| 5,550,423 | 8/1996 | Oughton | 313/112 |

*Primary Examiner*—Vip Patel

*Attorney, Agent, or Firm*—Jay G. Taylor; Brian T. Ster; Ice Miller Donadio & Ryan

[57] ABSTRACT

A dual-filament reflective infrared bulb has high and low beam filaments in spaced adjacency along a longitudinal bulb axis. A longitudinal envelope structure encloses each filament in a separate substantially ellipsoidal chamber. The outer surface of the envelope structure is coated with dichroic layers and provides focused reflectance of infrared radiation back onto the filaments. The common ground lead of the assembly passes through one of the chambers substantially off of the longitudinal axis and thereby off of the focal axis of the infrared radiation. A lead emanates out of one longitudinal end of the envelope structure and is formed to return in spaced adjacency toward the opposite longitudinal end. A bulb shield is fastened to the return portion of the lead and intermediate one of the chambers and the leads.

8 Claims, 4 Drawing Sheets

OPTICALLY-COATED DUAL-FILAMENT BULB FOR SINGLE COMPARTMENT HEADLAMP

TECHNICAL FIELD

The present invention generally is related to automotive lighting, and more particularly is related to headlamps employing a single compartment or housing for both high and low beam filaments.

BACKGROUND OF THE INVENTION

In a conventional halogen bulb, approximately less than 20 percent of the energy output is radiated as visible light. The remaining approximately greater than 80 percent is radiated as infrared light. Since the purpose of a halogen bulb in a vehicle headlamp application is to illuminate the roadway, the infrared radiation is substantially wasted energy. Hence, such bulb designs are generally considered to be relatively inefficient light providers.

Reflective infrared (hereafter RIR) bulbs are known which employ multi-layer dichroic coatings on the outer surface of the bulb. The dichroic coatings generally are adapted to pass wavelengths of visible light and to reflect back wavelengths of infrared light. The structure of the filament and bulb enclosure is such that reflected infrared light is relatively well focused upon the filament along substantially its entire length. Such arrangement provides for filament heating resulting in a more efficient bulb. This all translates into more visible light output for a given power consumption or less power consumption at a given light output. Such designs may be acceptable for relatively long filaments since end losses are a relatively small fraction of the total infrared radiation.

However, RIR bulbs have been successfully adapted for use in automotive headlamps which are characterized by packaging constraints which favor shorter filament lengths and hence increase the fraction of infrared radiation end losses. Such adaptations generally may be characterized by quasi-elliptical envelope structures which tend to redirect otherwise wasted end radiated infrared energy back to the filament thus reducing the overall fraction of infrared radiation end losses. However, they are limited in their application to vehicles having separate high and low beam reflectors. This application limitation is due to several factors. Combined single reflector high and low beam arrangements require a pair of filaments—one for the high beam and one for the low beam. Inclusion of both filaments in a single compact bulb enclosure, such as for example well known industry standard 9004 transverse or 9007 axial, requires non-axial adjacency of the filaments and hence one or neither, but never both, filaments can be accommodated on a centerline focal point of the bulb enclosure in order to benefit from the infrared redirection. Inclusion of both filaments in a single bulb enclosure is known in the industry standard H4 bulb which is characterized by axial adjacency of the high and low beam filaments. However, an H4 type of arrangement would produce undesirably high end losses. Additionally, the low beam shield which is proximate the low beam filament and internal to the bulb enclosure may be heated to unacceptably high temperatures resulting in shield glow which detrimentally affects the optics.

SUMMARY OF THE INVENTION

The present invention provides for a dual filament bulb assembly adapted for use in a single compartment headlamp.

In accordance with the invention, the bulb assembly has a low beam and a high beam filament specifically arranged in spaced adjacency along a common longitudinal axis of the bulb assembly. A dual-chamber envelope structure having longitudinally opposite ends encloses the filaments in separate ellipsoidally shaped chambers which are adapted to provide focused reflectance of infrared radiation originating at the filaments back onto the filaments. An electrical lead coupled to at least one of the filaments protrudes through one end of the envelope structure and is formed to return alongside the longitudinal envelope structure in transverse spaced adjacency to the envelope structure. A bulb shield is attached to the electrical lead to be supported mechanically thereby intermediate the lead and portion of the bulb assembly corresponding to one of the filaments.

In accordance with a preferred form of the invention, the lead providing mounting to the shield is the power lead for the low beam filament and the shield is intermediate the lead and portion of the bulb assembly corresponding to the low beam filament.

In accordance with another form of the invention, the lead providing mounting to the shield is a common ground lead for the low and high beam filaments and the shield is intermediate the common ground lead and portion of the bulb assembly corresponding to the low beam filament.

In accordance with one aspect of the present invention, a common ground lead is coupled to both filaments and passed through the chamber corresponding to one of the filaments in an orientation substantially off of the longitudinal axis of the bulb assembly.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
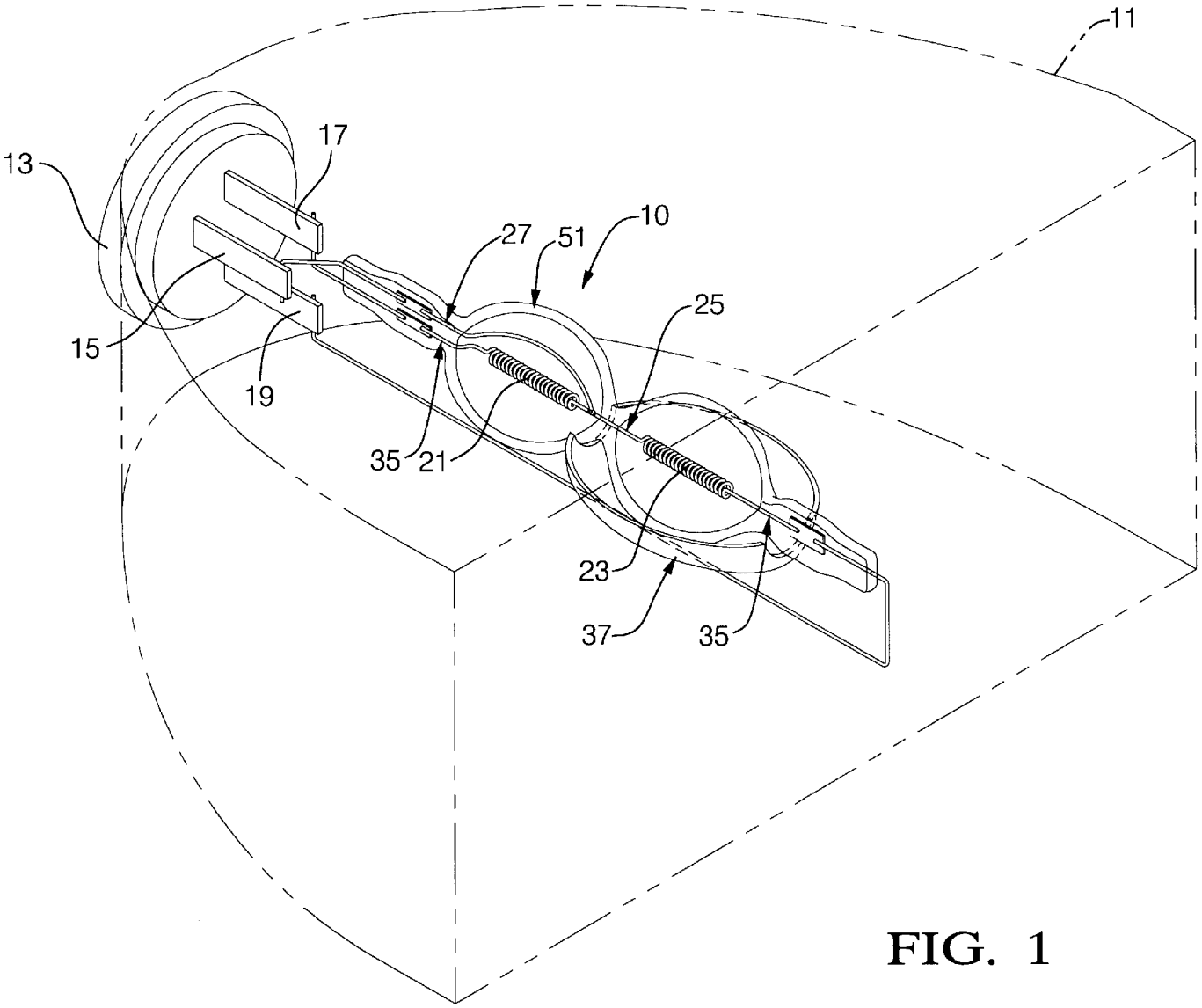
FIG. 1 is a view of an axial twin-filament RIR bulb assembly in accord with the present invention.
Figure 2:
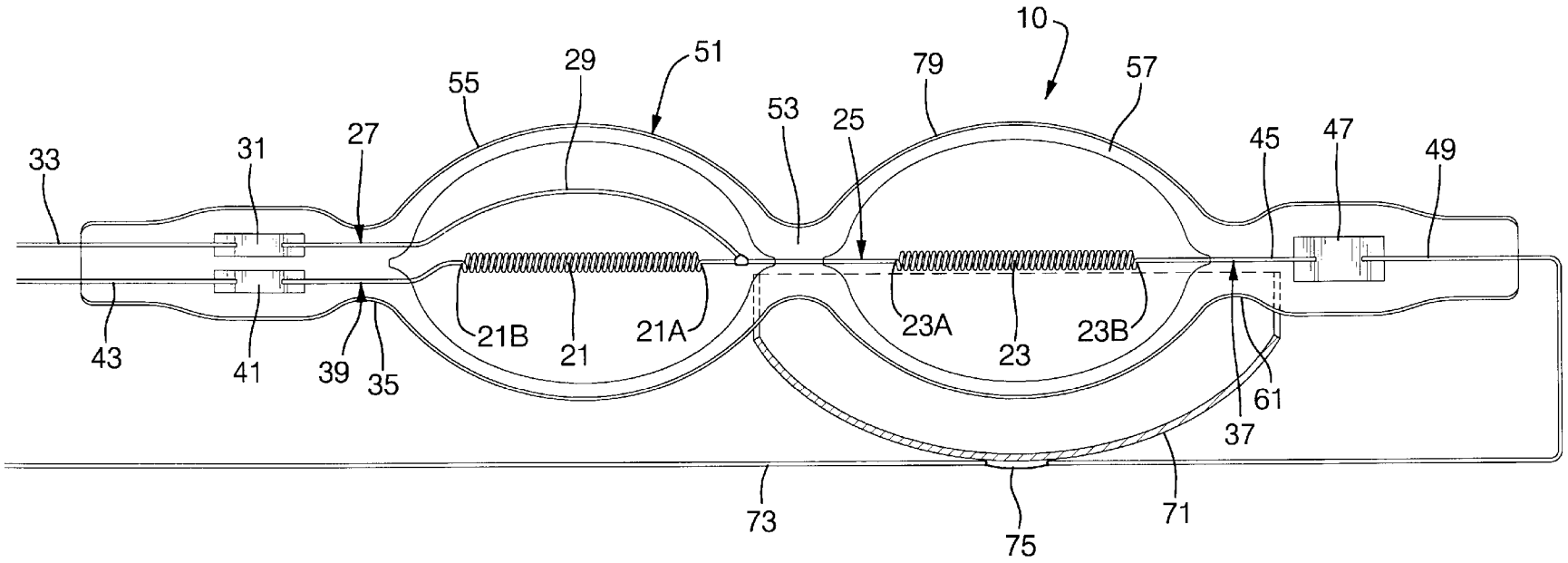
FIG. 2 is a side view of the axial twin-filament RIR bulb assembly in accord with the present invention.
Figure 3:
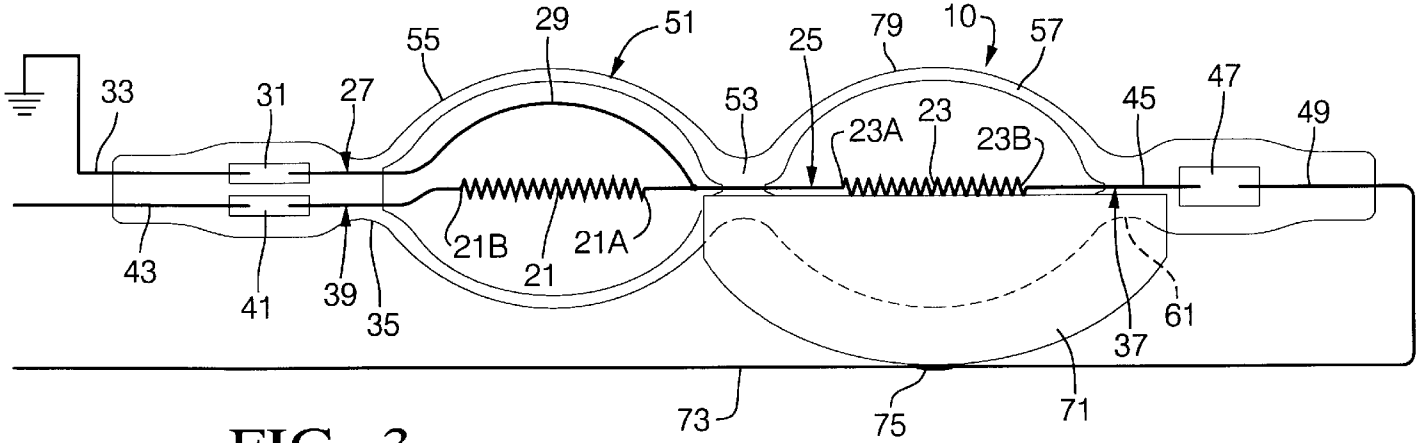
FIG. 3 is a schematic side view of the axial twin-filament RIR bulb assembly of the present invention.
Figure 4:
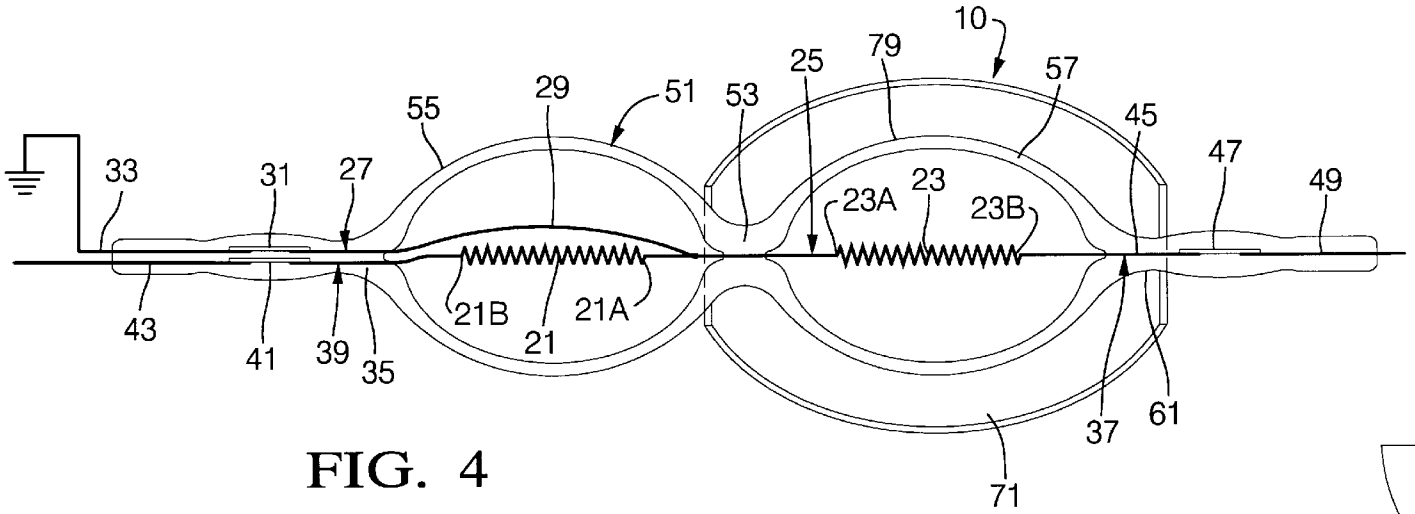
FIG. 4 is a schematic plan view of the axial twin-filament RIR bulb assembly of the present invention.
Figure 5:
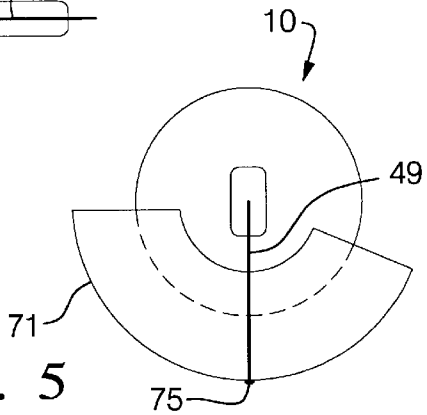
FIG. 5 is a schematic end view of the axial twin-filament RIR bulb assembly of the present invention; and, FIG. 6 is a side view of an alternative axial twin-filament RIR bulb assembly in accord with the present invention.

Referring to FIG. 1, a preferred embodiment of an RIR bulb assembly generally designated by the numeral 10 in accord with the present invention is illustrated in an intended application as the illumination source of a single compartment headlamp. A complementary headlamp enclosure 11 including reflective surfaces is illustrated in broken lines. An exemplary bulb mounting provision is also illustrated and comprises a base 13 carrying three terminals. The terminals in the present embodiment are designated 15, 17, and 19 and correspond, respectively to a common ground lead, a high beam lead and a low beam lead for the bulb and interfaced vehicle harness (not shown).

With reference now to FIGS. 1 through 5 wherein like numerals used between the various views correspond to like features, a preferred embodiment of the invention is portrayed. An RIR bulb assembly 10 is generally defined along a major longitudinal axis. A pair of filaments 21 and 23 are substantially aligned or coextensive with the axis. Functionally, filament 21 corresponds to high beam illumination while filament 23 corresponds to low beam illumination. The filaments 21 and 23 are preferably formed of tungsten. The filaments are further characterized by spaced adjacency with respect to their cooperative placement along the axis. That is to say, the high beam filament 21 and low beam filament 23 are separated by a distance along the common longitudinal axis. The filaments are electrically coupled at respective adjacent opposing ends 21A and 23A by conductor 25. The conductor 25 is common in the physical sense that it joins the two filaments and in the electrical sense that it provides an electrical ground node for both filaments. Conductor 25 is further electrically coupled to ground conductor 27 comprising, in the preferred structure, a first portion formed as an internal bulb lead 29 directly coupled at one end to conductor 25 and at the other end to a second portion formed as a foil strip 31 for example from molybdenum. The foil strip 31 is also coupled, opposite the internal bulb lead coupling, to a third portion formed as an externalizing lead 33. The first portion 29 of the ground conductor is importantly located significantly off-axis with respect to the longitudinal axis.

Each of the high beam filament 21 and low beam filament 23 has a power conductor, 35 and 37 respectively, coupled to corresponding non-adjacent opposing ends 21B and 23B respectively. In the preferred structure, respective first portions formed as internal bulb leads 39 and 45 directly couples at one end to the non-adjacent opposing ends 21B and 23B and at the other end to a respective second portion formed as a foil strip 41 and 47 for example from molybdenum. Each foil strip 41 and 47 is also coupled, opposite the respective internal bulb lead coupling, to a third portion formed as an externalizing leads 43 and 49. All conductors are preferably formed from molybdenum.

A dual chamber envelope 51, formed of glass or quartz, is characterized by a longitudinally central pinch-off region 53 substantially equidistantly intermediate the adjacent opposing ends 21A and 23A of the high and low beam filaments 21 and 23. Each respective chamber 55 and 57 is substantially ellipsoidally formed. Respective end pinch-off regions 59 and 61 hermetically seal the chambers from the atmosphere and provide sealed externalization paths for the respective externalizing leads 33, 43, and 49. Each chamber is pressure filled with an appropriate inert and halogen gas mixture.

Conventional multi-layer dichroic coatings 79, for example magnesium fluoride or silicon dioxide, are deposited on the exterior surface of the dual chamber envelope at least in the major areas located between the various pinch-off regions. The combination of the coating and substantially elliptical chambers is effective in accordance with well known principles to selectively reflect predominantly infrared and greater wavelengths of light emitted from the filaments back to the filaments in substantially focused fashion while allowing passage of the lesser wavelengths of light including the visible spectrum. The significantly off-axis placement of internal bulb lead 29 advantageously ensures that insubstantial or non-concentrated infrared light is redirected for absorption thereby. Consequently, the lead operates relatively cool and is not subject to excessive temperature conditions and/or undesirable glow conditions.

A shield 71 formed from molybdenum or other high temperature metal is advantageously externally located below chamber 57 corresponding to low beam filament 23. Externalizing lead 49 is formed to return in spaced adjacency to the bulb 10 along its length. The shield 71 is mechanically fastened, such as by tack welding 75, to the return length 73 of the externalizing lead 49. The shield 71, too, is in spaced adjacency to the bulb 10 and hence is not subjected to the extreme heat closer to the bulb and consequently is not heated to a temperature whereat it undesirably glows. Shield 71 extends substantially the entire axial length of the low beam filament 23 and preferably, as illustrated, beyond the ends 23A and 23B thereof into the pinch-off areas 53 and 61. The main purpose of the shield is, of course, to limit low beam glare from the low beam filament and to provide for sharp cut-off for dark areas. Important secondary effects of the shield orientation include, as mentioned, elimination of shield glow, blocking of bulb glow which is characteristic of coated bulbs, and elimination of glare light from reflectance off of the externalization lead 49, particularly with respect to return length 73.

Figure 6:
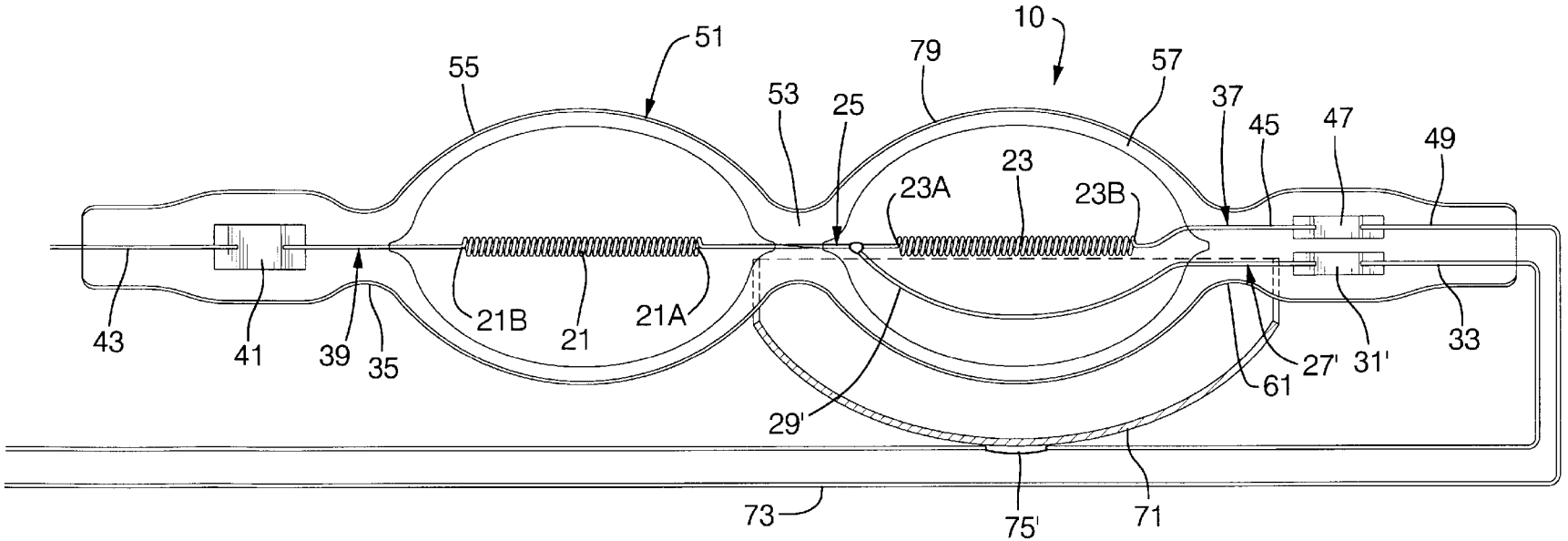

With reference to FIG. 6, an alternate embodiment of the present invention is illustrated. In the figure, ground conductor 27' includes first, second and third portions 29', 31' and 33', respectively. First portion 29' is located significantly off-axis with respect to the longitudinal axis. In this embodiment, the third portion externalizing lead 33' is formed to return toward the other end of the bulb assembly. The lead 33' is fastened to the shield 71 which is thereby supported between the lead 33' and a corresponding chamber.

While the invention has been described with respect to certain preferred embodiments, it is anticipated that certain modifications, changes and substitutions may be apparent to one having ordinary skill in the art and therefore are given by way of non-limiting example.

I claim:

1. A dual-filament bulb assembly for use in a single compartment headlamp of a motor vehicle comprising;

a longitudinal filament axis;

an elongated low beam filament substantially coextensive with the axis;

an elongated high beam filament substantially coextensive with the axis and in axially spaced adjacency with the first filament;

a dual-chamber envelope structure having longitudinally opposite ends, the envelope structure enclosing the filaments and providing focused reflectance of infrared radiation originating from each filament back onto the respective originating filament; and a bulb shield in spaced adjacency to the low beam filament external to the envelope structure.

2. A dual-filament bulb assembly as claimed in claim 1 further comprising an electrical lead running longitudinally in transverse spaced adjacency to the bulb assembly and supporting the bulb shield.

3. A dual-filament bulb assembly as claimed in claim 1 further comprising a common electrical lead coupled axially intermediate both filaments and running longitudinally in transverse spaced adjacency to one of the filaments substantially off axis and enclosed by the envelope structure.

4. A dual-filament bulb assembly as claimed in claim 1 wherein each chamber of said envelope structure is substantially ellipsoidal, and said focused reflectance of infrared radiation is provided by a dichroic coating deposited on said envelope structure.

5. A dual-filament bulb assembly for use in a single compartment headlamp of a motor vehicle comprising:

a longitudinal filament axis;

an elongated first filament substantially coextensive with the axis;

an elongated second filament substantially coextensive with the axis and in axially spaced adjacency with the first filament;

a dual-chamber envelope structure having longitudinally opposite ends, the envelope structure enclosing the filaments and providing focused reflectance of infrared radiation originating from each filament back onto the respective originating filament;

a first lead emanating from one of the longitudinally opposite ends of the envelope structure, the first lead being formed to return toward the other longitudinally opposite end of the envelope structure in spaced adjacency to the envelope structure; and a bulb shield attached to the first lead longitudinally intermediate the opposite ends of the envelope structure and transversely intermediate one of the chambers of the envelope structure and the first lead, whereby the lead supports the bulb shield.

6. A dual-filament bulb assembly as claimed in claim 5 wherein the first and second filaments are coupled to a second lead at a location axially intermediate the filaments, the second lead passing through one of the chambers of the envelope structure substantially off axis in spaced adjacency to the filament enclosed therein.

7. A dual-filament bulb assembly as claimed in claim 5 wherein the first lead passes through one of the chambers of the envelope structure substantially off axis in spaced adjacency to the filament enclosed therein and is coupled to the first and second filaments at a location axially intermediate the filaments.

8. A dual-filament bulb assembly for use in a single compartment headlamp of a motor vehicle comprising:

a longitudinal filament axis;

an elongated first filament substantially coextensive with the axis;

an elongated second filament substantially coextensive with the axis and in axially spaced adjacency with the first filament;

a dual-chamber envelope structure having longitudinally opposite ends, the envelope structure enclosing the filaments in respective substantially ellipsoidal chambers, the envelope structure having deposited thereon an infrared reflective coating providing focused reflectance of infrared radiation originating from each filament back onto the respective originating filament;

a first lead emanating from one of the longitudinally opposite ends of the envelope structure, the first lead being formed to return toward the other longitudinally opposite end of the envelope structure in transverse spaced adjacency to the envelope structure;

a second lead coupled to the first and second filaments at a location axially intermediate the filaments, the second lead passing through one of the chambers of the envelope structure substantially off axis in transverse spaced adjacency to the filament enclosed therein; and a bulb shield attached to the first lead longitudinally intermediate the opposite ends of the envelope structure and transversely intermediate one of the chambers of the envelope structure and the first lead, whereby the first lead supports the bulb shield.

* * * * *